US007744342B2

(12) United States Patent
Kamoshita et al.

(10) Patent No.: US 7,744,342 B2
(45) Date of Patent: Jun. 29, 2010

(54) BLOWER FAN AND WORKING MACHINE PROVIDED WITH THE SAME

(75) Inventors: Tadashi Kamoshita, Tokyo (JP); Tomoko Tada, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 603 days.

(21) Appl. No.: 11/294,967

(22) Filed: Dec. 6, 2005

(65) Prior Publication Data

US 2006/0153674 A1 Jul. 13, 2006

(30) Foreign Application Priority Data

Jan. 11, 2005 (JP) ..... 2005-004082

(51) Int. Cl.
*F04D 29/66* (2006.01)

(52) U.S. Cl. ..... 415/119; 415/121.2; 415/206

(58) Field of Classification Search ..... 415/119, 415/121.2, 126, 127, 128, 206, 151, 159; 181/214; 15/330
See application file for complete search history.

(56) References Cited

U.S. PATENT DOCUMENTS 1,797,293 A * 3/1931 McIlvaine ..... 49/39
2,013,816 A * 9/1935 West ..... 415/121.2
2,603,411 A * 7/1952 Trumpa ..... 415/150
3,396,904 A * 8/1968 Janette ..... 251/78
4,044,750 A * 8/1977 Zeigler ..... 126/25 B
4,316,077 A * 2/1982 Carlson ..... 392/379
5,048,202 A * 9/1991 Shero ..... 34/618
5,174,048 A * 12/1992 Shero ..... 34/444
5,316,439 A * 5/1994 Gatley et al. ..... 415/119
5,551,836 A * 9/1996 Roth et al. ..... 415/204
5,997,246 A * 12/1999 Humbad ..... 415/119
6,116,375 A * 9/2000 Lorch et al. ..... 181/224
6,183,200 B1 * 2/2001 Chang ..... 416/146 R
6,200,093 B1 * 3/2001 Lee et al. ..... 415/204
6,202,322 B1 * 3/2001 Turner, IV ..... 34/618
6,677,564 B1 * 1/2004 Sohn et al. ..... 219/757

* cited by examiner

*Primary Examiner*—Edward Look
*Assistant Examiner*—Aaron R Eastman
(74) *Attorney, Agent, or Firm*—Baker Botts L.L.P.

(57) ABSTRACT

A blower fan includes: an impeller having a predetermined number of blades; a fan casing having an air-intake port disposed to face a central portion of base of the impeller and eccentrically housing the blower fan and defining a spiral scroll passageway between an inner wall thereof and an external circumference of the impeller, the spiral scroll passageway having an inlet portion constituting a narrow nose portion and an outlet portion constituting a wide discharge port; and a driving source for rotating the impeller. In order to minimize the noise to be released from the nose portion, the blower fan further includes a sound-reflecting means which is disposed to cover a portion of the air inlet port at a location spaced away from the nose portion by a distance corresponding to ½ of wavelength of noise in an emanating direction of noise.

16 Claims, 5 Drawing Sheets

BLOWER FAN AND WORKING MACHINE PROVIDED WITH THE SAME

FIELD OF THE INVENTION

The present invention relates to a blower fan including an impeller, a fan casing defining a spiral scroll passageway between an inner wall thereof and the impeller, and a driving source for rotating the impeller. Further, the present invention also relates to an air-blowing working machine provided with the blower fan, such as a power blower and a sprayer.

BACKGROUND INFORMATION

In an air-blowing working machine of portable type (hand-held type or shoulder type) such as a power blower and a sprayer for example, a centrifugal blower fan has been conventionally employed for generating a high-velocity air flow. This blower fan is generally constituted by an impeller including a predetermined number of blades which are radially arranged on a base; a fan casing having an air-intake port disposed to face a central portion of the base of the impeller and eccentrically housing the blower fan and defining a spiral scroll passageway between an inner wall thereof and an external circumference of the impeller, the spiral scroll passageway having an inlet portion which is constituted by a narrow nose portion and an outlet portion which is constituted by a wide discharge port; and a driving source for rotating the impeller such as an internal combustion engine and an electric motor (see for example, JP Laid-open Patent Publication (Kokai) No. 10-196596 (1998)).

This conventional blower fan however is accompanied with a problem of noise to be released to environments. This noise generates from the impingement of air against the narrow nose portion after the air has been most greatly compressed at region in the vicinity of the narrow nose portion. It is already known that the noise originating from this nose portion will be released directly from the air intake port to environments. In an attempt to minimize this noise, solutions such as modifying the configuration of blades or of impeller or to change the configuration of the air intake port (which is generally circular) as shown in JP Laid-open Patent Publication (Kokai) No. 1'-182499 (1999)) and JP Laid-open Patent Publication (Kokai) No. 7-91392 (1995)) have been proposed.

As described above, in order to overcome the problem of noise, the construction of the components of conventional blower fan needs to be modified to a great amount, resulting in the complication of the structure of blower fan and also in the deterioration in performance of blower fan (deterioration of air intake efficiency or air discharge capacity, etc.) for the sake of the reduction of noise.

SUMMARY OF THE INVENTION

The present invention has been made in view of overcoming the aforementioned problems of the prior art, and therefore an object of the present invention is to provide a blower fan which is capable, using a relatively simple construction, of effectively minimizing the noise to be released directly to the environments from the nose portion as a source of noise without necessitating a great amount of modification of the construction of conventional components of fan and also without inviting any substantial deterioration in performance of blower fan.

Another object of the present invention is to provide an air-blowing working machine provided with such a blower fan.

With a view to realize the aforementioned object, the present invention provides a blower fan which essentially includes: an impeller having a predetermined number of blades; a fan casing having an air-intake port disposed to face a central portion of a substrate of the impeller and eccentrically housing the blower fan and defining a spiral scroll passageway between an inner wall thereof and an external circumference of the impeller, the spiral scroll passageway having an inlet portion which is constituted by a narrow nose portion and an outlet portion which is constituted by a wide discharge port; and a driving source for rotating the impeller.

In order to minimize the noise to be released to the environments from the nose portion as a source of noise, the blower fan is characterized to include a sound-reflecting means which is disposed to cover a portion of the air inlet port at a location which is spaced away from the nose portion by a distance corresponding to a half (½) of wavelength of noise in an emanating direction of noise to be minimized.

In a preferable embodiment, a tray-like fan cover having a lattice-like framework provided with a large number of air-intake openings is disposed to cover the air inlet port, wherein some of the air-intake openings are closed to form a blind patch, thus enabling the fan cover to function as the sound-reflecting means.

In another preferable embodiment, the position of the sound-reflecting means is made variable in accordance with the revolving speed of the impeller.

Further, the air-blowing working machine is characterized in that it is provided with a blower fan which is constructed as described above.

The blower fan according to the present invention is provided with a sound-reflecting means such as a reflection plate (or a blind patch) so as to cover a portion of the air inlet port at a location which is spaced away in an emanating direction of noise to be minimized from the nose portion or a noise-generating source by a distance corresponding to a half (½) of wavelength of noise. Therefore, the noise (sound wave) generated at the nose portion is caused to impinge against a reflection plate (or blind patch) and rebounded therefrom without being directly released to the environment from the air inlet port, thus at least a portion of the noise is turned back, as a wave of opposite phase, to the nose portion or the noise-generating source. Therefore, the noise (sound wave) generated at the nose portion is attenuated by this reflected wave of opposite phase, thereby making it possible to effectively minimize the noise directly released to the environments.

Further, according to the blower fan of the present invention, since it is only required to additionally mount a reflection plate on the conventional blower fan or to attach a blind patch to the conventional fan cover, it is advantageous in terms of manufacturing cost as compared with the modifications conventionally proposed which necessitate a large scale of modification and may invite the complication of structure. Furthermore, since only a portion of the air inlet port is required to be covered with the reflection plate (or blind patch) as sound-reflecting means, the performance of blower fan would not be adversely affected in any substantial manner.

DETAILED DESCRIPTION OF THE EXEMPLARY EMBODIMENTS

The specific embodiments of the present invention will be explained below with reference to drawings.

Figure 1:
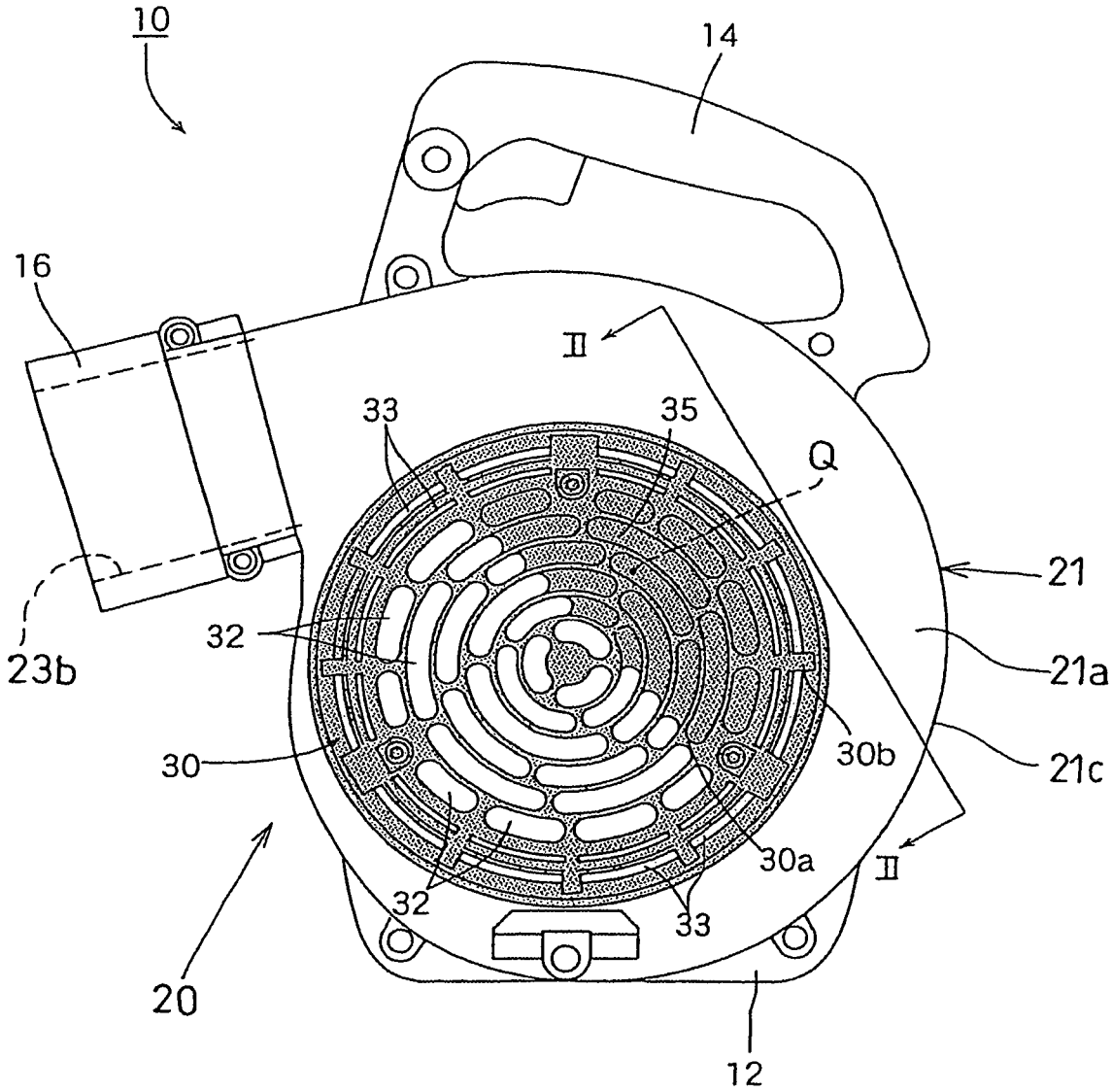
FIG. 1 is a left side view of a hand-held type power blower representing one exemplary embodiment of an air-blowing working machine provided with a blower fan of the present invention.

FIG. 1 shows one embodiment of a hand-held type power blower representing one example of the air-blowing working machine provided with a blower fan of the present invention.

Figure 2:
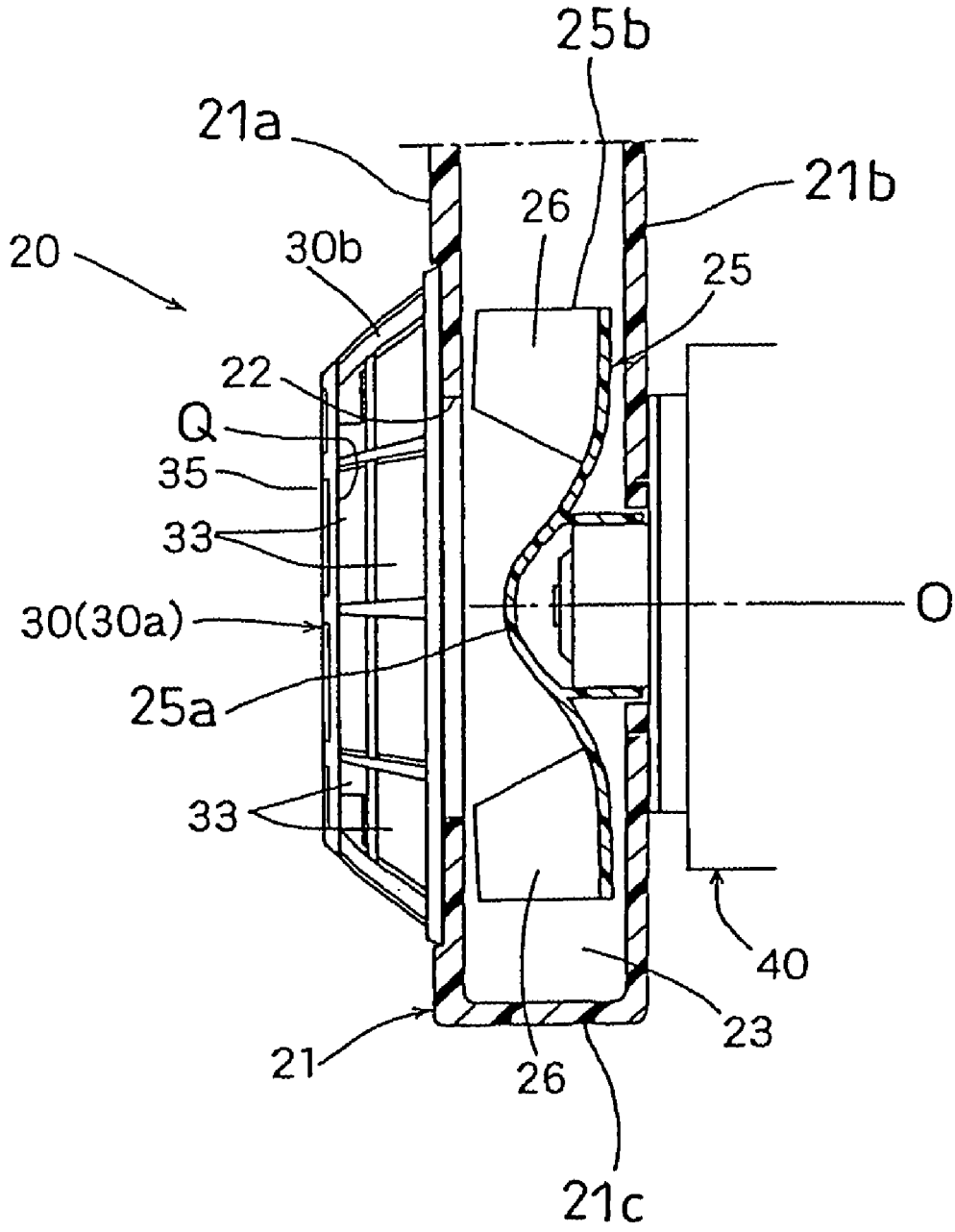
FIG. 2 is a cross-sectional view taken along the line II-II of FIG. 1.
Figure 3:
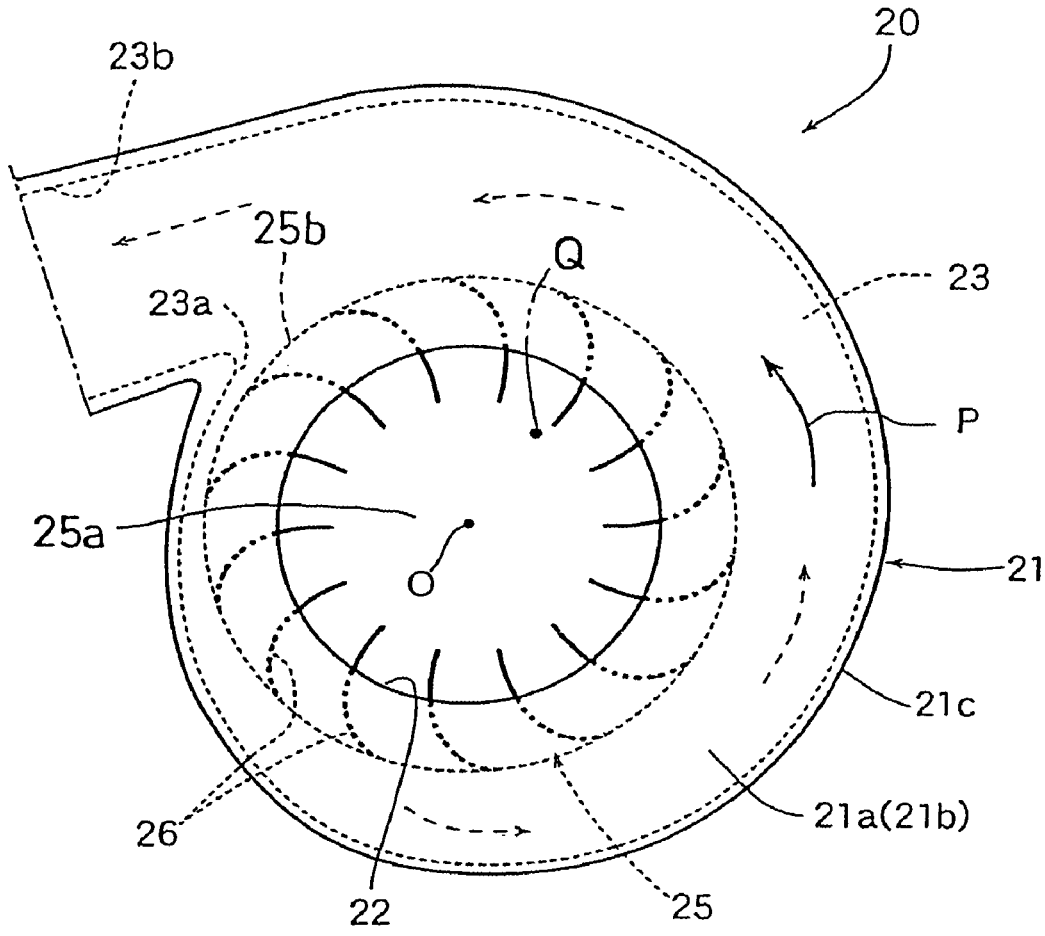
FIG. 3 is a side view illustrating a state where the fan cover of the blower fan shown in FIG. 1 is removed.

The power blower 10 shown herein includes a stand 12, a handle 14, and a centrifugal type blower fan 20 where a connecting coupler 16 for an injection pipe (not shown) is mounted. As shown in FIGS. 2 and 3 in addition to FIG. 1, this centrifugal type blower fan 20 includes: a circular impeller 25 including a predetermined number (herein 14 pieces) of curved blades 26 which are radially arranged at equiangular intervals on a base 25*a*; a fan casing 21 housing the impeller 25; and a driving source 40 such as an internal combustion engine and an electric motor for rotating the impeller 25 in counterclockwise (i.e., in the revolving direction of P shown in FIGS. 3 and 4).

Figure 4:
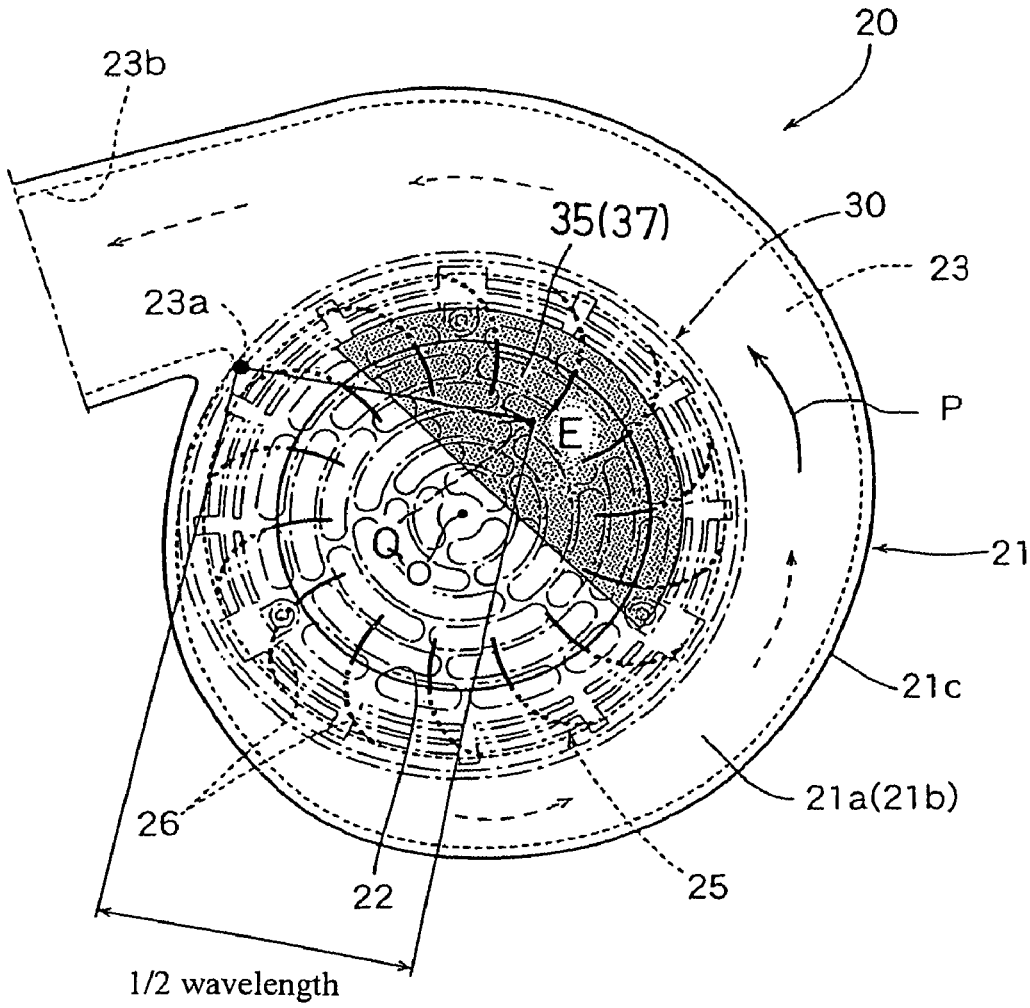
FIG. 4 is a side view for explaining about the position of the blind patch and the reflection plate.

The fan casing 21 is constituted by a front plate portion 21*a*, a rear plate portion 21*b* and a side plate portion 21*c*. In this fan casing 21, the impeller 25 is housed eccentrically, i.e. offset leftward as shown in FIGS. 3 and 4. The front plate portion 21*a* is provided with an air inlet port 22 which is located so as to coaxially face a central portion of the base 25*a* of impeller 25. Between the inner wall of fan casing 21 and the external circumference 25*b* of the impeller 25, there is defined a spiral scroll passageway having a narrow nose portion 23*a* constituting an inlet portion of the passageway and a wide discharge port 23*b* constituting an outlet portion of the passageway.

A tray-like (trapezoidal in cross-section) fan cover 30 having a lattice-like framework is disposed so as to cover the air inlet port 22. A large number of air intake openings 32 having an elliptical configuration extending circumferential direction in various lengths are formed, in a prescribed arrangement, on the bottom portion 30*a* (the side that appears in FIG. 1) of the fan cover 30. Further, a large number of air intake openings 33 having a rectangular configuration extending circumferential direction in various lengths are formed, in a prescribed arrangement, on the peripheral wall portion 30*b* (see FIG. 2) of the fan cover 30.

Figure 5:
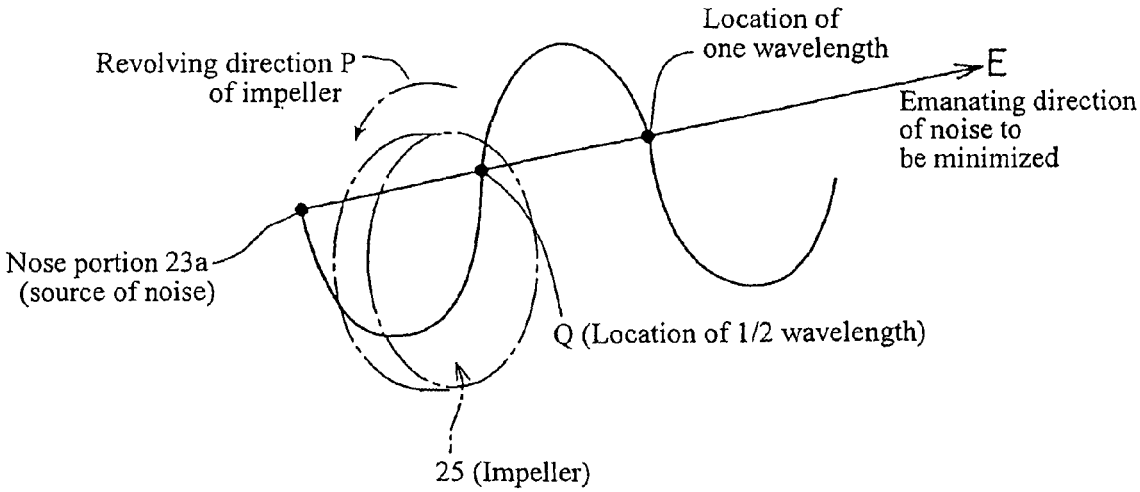
FIG. 5 is a diagram for explaining about the distance corresponding to ½ wavelength of noise from the nose portion.

In this embodiment, for the purpose of minimizing the noise (whistle noise) to be released from the nose portion 23*a* as a source of noise, a semicircular region which is located at an oblique right-hand upper portion (a shaded portion) in FIG. 1 is constituted by a blind patch portion 35 as a sound reflection means wherein some of the air intake openings 32 are closed. As shown in FIG. 4, the blind patch portion 35 in this case is located at a position whose center Q is spaced away in an emanating direction of noise (sound wave) from the nose portion 23*a* (a direction orthogonally intersecting the tangent line to the nose portion 23*a*) by a distance corresponding to a half (½) of wavelength of noise under the condition where the revolving speed of the impeller 25 during the ordinary operation is assumed to be 7000 rpm for instance (see also FIG. 5).

More specifically, the wavelength λ of noise (sound wave) can be generally represented by the following formula (1).

$$\text{Wavelength } \lambda = \text{Sound velocity (distance)/Frequency (Hz)} \quad (1)$$

If the normal revolving speed (N) of the impeller 25 is 7000 rpm and the number (Z) of blades 26 is 14, the N*Z frequency component (peak frequency) would become 7000*14/60=1630 Hz.

If the temperature of air at the working site is assumed as being 30° C., the sound velocity would be about 350 m/s, and hence, based on the aforementioned formula (1), the wavelength of noise would become: wavelength λ=350/1630=0.214 m. Therefore, ½ wavelength would become 107 mm.

Based on this principle, the size and configuration of the fan cover 30 (the position and size of the blind patch portion 35) are designed such that the point Q which is spaced away, along the emanating direction E of noise to be minimized, from the nose portion 23*a* toward the average position of the operator's ear by a distance of 107 mm corresponding to a half (½) of wavelength of noise coincides with approximately the central portion of the blind patch portion 35.

As described above, according to the blower fan 20 of this embodiment, since the blind patch portion 35 is mounted on the fan cover 30 in such a manner that the blind patch portion 35 covers part of the air inlet port 22 and that the center portion of the blind patch portion 35 coincides with the position Q which is spaced away, along the emanating direction E of noise which is most unpleasant to the ear, from the nose portion 23*a* or a source of noise by a distance corresponding to a half (½) of wavelength of noise, at least part of the noise (sound wave) generated from the nose portion 23*a* is forced to impinge against the inner surface of the blind patch portion 35 and rebounded back, as a sound wave of the opposite phase, toward the nose portion 23*a* or a source of noise. As a result, the noise (sound wave) generated from the nose portion 23*a* can be attenuated by this reflected wave of the opposite phase, thus making it possible to effectively minimize the noise directly released to the environments.

According to the blower fan 20 of this embodiment, since it is only required to additionally mount the blind patch portion 35 on the conventional fan cover 30 (or to close some of the air intake openings 32), it is advantageous in terms of manufacturing cost as compared with the modifications conventionally proposed which necessitate a large scale of modification and may invite the complication of structure. Furthermore, since only a portion of the air inlet port 23*a* is required to be covered with the blind patch portion 35 from the foreside of the inlet port 23*a*, the performance of blower fan would not be adversely affected in any substantial manner.

Figure 6:
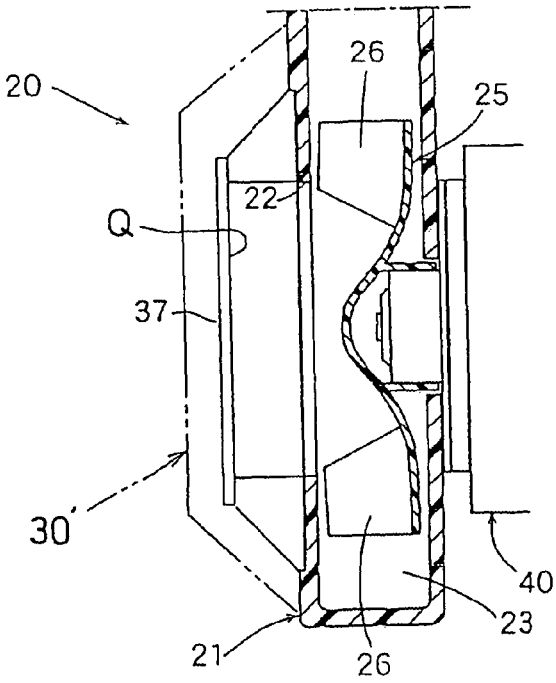
FIG. 6 is a cross-sectional view illustrating one example where a reflection plate is mounted separate from the fan cover.

Additionally, in the foregoing embodiment, although the blind patch portion 35 is formed directly on the fan cover 30 itself, the blind patch portion 35 may be disposed separate from the fan cover. Namely, as shown by a solid line in FIG. 6, a reflection plate 37 having the same construction as that of the blind patch portion 35 may be disposed as a sound wave reflection means at the same position as described above (i.e., at a position which is spaced away in an emanating direction of sound from the nose portion 23*a* by a distance corresponding to a half (½) of wavelength of sound) (the fan cover 30' in this case should be larger than that described in the foregoing embodiment). In this case also, it is possible to obtain almost the same effects as described above.

Experiment

In order to demonstrate the noise-reducing effect that can be derived from the provision of the blind patch 35 or the reflection plate 37 as a sound reflection means as described above, samples (A) and (B) of the present invention, and samples (C), (D), (E) and (F) of comparative examples, all constructed as described below, were prepared and the magnitude (dBvr) of noise thereof was respectively measured under the same conditions at a location 30 cm left rear side of the blower fan. The results obtained are described below.

Sample (A): The blind patch portion 35 was formed at a portion of the fan cover which was spaced away by a distance of ½ wavelength from the nose portion (FIGS. 1 to 3)—86.9 dBvr.

Sample (B): The fan cover was removed and the reflection plate 37 was disposed at the location which was spaced away by a distance of ½ wavelength from the nose portion (FIG. 6)—84.4 dBvr.

Sample (C): A standard fan cover which was not provided with the blind patch portion was mounted on the blower fan—99.8 dBvr.

Sample (D): The blower fan without a fan cover—96.0 dBvr.

Sample (E): The fan cover was removed and the reflection plate 37 was disposed at the location which was spaced away by a distance of one wavelength from the nose portion—97.2 dBvr.

Sample (F): The fan cover was removed and the reflection plate 37 was disposed at the location which was spaced away by a distance of ¼ wavelength from the nose portion—98.5 dBvr.

It will be recognized from the results of the aforementioned comparative tests that it was possible, through the use of the blower fans according to the present invention, to reduce the level of noise by a magnitude of not less than 10 dBvr as compared with the blower fan of the comparative examples, thus demonstrating a great noise-reducing effect that can be derived from the use of the blower fan of the present invention. Additionally, according to the blower fan of the present invention, the reduction of the level of noise was recognized not only in the emanating direction E of noise directed to the operator's ears, but also in the entire emanating direction of noise around the blower fan. Further, the leak of noise or the generation of other noise sources due to the provision of the reflection plate or the blind patch portion was not recognized at all. Moreover, even when the employment of the blind patch portion 35 and the reflection plate 37 according to the present invention were applied to other kinds of blower fan in the aforementioned comparison tests, almost the same results as described above were obtained.

Further, since the aforementioned location corresponding to ½ wavelength changes depending on the revolving velocity of the impeller 25, the blower fan may be constructed such that the position of the reflection plate 37 or of the blind patch portion 35 is made automatically variable depending on the revolving velocity of the impeller 25 (changes of the position of throttle or negative pressure) especially in the case where the working revolving velocity of the impeller 25 is enabled to change greatly.

In addition, in the case where the working revolving velocity is made variable at a plurality of fixed points, the blower fan may be constructed such that the reflection plate is enabled to be relocated at any one of the positions corresponding to the predetermined number of fixed points.

Different from those of sound insulation wall type where some degree of mass is required to be used, the sound reflection means according to the present invention may be constructed in any manner as long as it is capable of inverting the phase of sound wave and reflecting the phase-inverted sound toward the nose portion. For example, the sound reflection means may be formed of a thin membrane so as to make it light in weight or formed of a parabola-like reflection plate so as to further enhance the noise reducing effect.

What is claimed is:

1. A blower fan comprising:

a circular impeller having a base and a predetermined number of curved blades radially arranged at equiangular intervals on the base;

a fan casing having an air-intake port disposed to face a central portion of a substrate of the impeller and eccentrically housing the blower fan and defining a spiral scroll passageway between an inner wall thereof and an external circumference of the impeller, the spiral scroll passageway having an inlet portion comprising a narrow nose portion and an outlet portion which comprises a wide discharge port;

a driving source for rotating the impeller;

a narrow nose portion that is a noise source of said fan, wherein a force of air within the fan is most greatly compressed in the inside of the spiral scroll passageway; and a sound-reflecting member formed as a blind patch portion that covers part of the air intake port in order to minimize the noise to be released to the external environments from the narrow nose portion as a source of noise, where the blind patch portion is disposed at a position whose center is spaced away in an emanating direction of noise from the narrow nose portion by a distance corresponding to a half (½) of wavelength of noise.

2. The blower fan according to claim 1, wherein the sound reflecting member comprises a tray-shaped fan cover having a lattice-shaped framework provided with at least three air-intake openings and disposed to cover the air inlet port, wherein at least two of the air-intake openings are closed to form a blind patch.

3. The blower fan according to claim 2, wherein the sound-reflecting member is capable of varying in position correlating to the revolving speed of the impeller.

4. An air blast working machine comprising the blower fan of claim 3.

5. An air blast working machine comprising the blower fan of claim 2.

6. The blower fan according to claim 1, wherein the sound-reflecting member is capable of varying in position correlating to the revolving speed of the impeller.

7. An air blast working machine comprising the blower fan of claim 6.

8. An air blast working machine comprising the blower fan of claim 1.

9. A blower fan comprising:

a circular impeller having a base and a predetermined number of curved blades radially arranged at equiangular intervals on the base;

a fan casing having an air-intake port disposed to face a central portion of a substrate of the impeller and eccentrically housing the blower fan and defining a spiral scroll passageway between an inner wall thereof and an external circumference of the impeller, the spiral scroll passageway having an inlet portion comprising a narrow nose portion and an outlet portion which comprises a wide discharge port;

a driving source for rotating the impeller;

a narrow nose portion that is a noise source of said fan, wherein a force of air within the fan is most greatly compressed in the inside of the spiral scroll passageway; and a sound-reflecting member made of a thin membrane, the sound-reflecting member being formed as a blind patch portion that covers part of the air intake port in order to minimize the noise to be released to the external environments from the narrow nose portion as a source of noise, where the blind patch portion is disposed at a position whose center is spaced away in an emanating direction of noise from the narrow nose portion by a distance corresponding to a half (½) of wavelength of noise.

10. The blower fan according to claim 9, wherein the sound reflecting member comprises a tray-shaped fan cover having a lattice-shaped framework provided with at least three air-intake openings and disposed to cover the air inlet port, wherein at least two of the air-intake openings are closed to form a blind patch.

11. The blower fan according to claim 10, wherein the sound-reflecting member is capable of varying in position correlating to the revolving speed of the impeller.

12. An air blast working machine comprising the blower fan of claim 11.

13. An air blast working machine comprising the blower fan of claim 10.

14. The blower fan according to claim 9, wherein the sound-reflecting member is capable of varying in position correlating to the revolving speed of the impeller.

15. An air blast working machine comprising the blower fan of claim 14.

16. An air blast working machine comprising the blower fan of claim 9.

* * * * *